US006446843B2

(12) United States Patent
Vezzani

(10) Patent No.: US 6,446,843 B2
(45) Date of Patent: Sep. 10, 2002

(54) METERING MACHINE WITH DEVICE FOR THE FINE METERING OF PASTA

(75) Inventor: Paolo Vezzani, Capannori (IT)

(73) Assignee: Studio Tecnico Per. Ind. Giuseppe Vezzani, Montecatini Terme (IT)

( * ) Notice: Subject to any disclaimer, the term of this patent is extended or adjusted under 35 U.S.C. 154(b) by 0 days.

(21) Appl. No.: 09/795,393

(22) Filed: Mar. 1, 2001

(30) Foreign Application Priority Data

Mar. 2, 2000 (IT) ..... MI000119 U

(51) Int. Cl.[7] ..... B65B 19/34

(52) U.S. Cl. ..... 222/434; 222/77; 222/196; 222/439; 222/440; 222/445; 222/451

(58) Field of Search ..... 222/77, 363, 196, 222/368, 434, 438, 439, 440, 445, 446, 447, 450, 451

(56) References Cited

U.S. PATENT DOCUMENTS 2,976,006 A * 3/1961 Stambera ..... 222/445
3,135,343 A * 6/1964 Stambera ..... 177/1
3,556,358 A * 1/1971 Armstrong ..... 222/445
4,446,992 A * 5/1984 Suzuki et al. ..... 222/447
4,610,322 A * 9/1986 Sugioka et al. ..... 177/1
5,108,012 A * 4/1992 Rosso ..... 222/200

FOREIGN PATENT DOCUMENTS

FR 2.104.954 9/1970
WO WO 93/17912 9/1993

* cited by examiner

*Primary Examiner*—Kenneth Bomberg
(74) *Attorney, Agent, or Firm*—Pillsbury Winthrop LLP

(57) ABSTRACT

A metering machine for pasta is described comprising a channel for the finishing of pasta, a shovel for the support of the pasta that flows in said finishing channel, a shovel for the metering of the pasta. The supporting shovel and the metering shovel are transversally insertable in the finishing channel and disinsertable from it in alternate way. The metering shovel and the supporting shovel are mechanically connected with each other so that a single driving device provides to their simultaneous and alternate transversal insertion and disinsertion.

6 Claims, 3 Drawing Sheets

METERING MACHINE WITH DEVICE FOR THE FINE METERING OF PASTA

The present invention refers to a metering machine with device for the fine metering of pasta.

Generally there are known industrial machines suitable for the packaging of pasta. Naturally the same pasta must be appropriately weighed before the packaging by means of metering machines so as to establish and to control the quantity required for the packaging.

Generally said metering machines are provided with finishing and roughing channels, in which metering shovels that set the amount of pasta to be distributed each time to the packaging machine are inserted transversally.

In the case of long cut pasta the metering carried in the finishing channel is done by inserting a metering shovel transversally to the same channel in an appropriated position above a shovel for the support of the pasta that is then extracted from the finishing channel so as to let the quantity of pasta comprised between the two shovels fall into a collection space below. Naturally the movements of the two shovels are controlled by separate mechanisms that make the machine undesirably complex and do not always allow the desirable perfect synchronism between the same movements, with a consequent possibility of error in the metering of the pasta and of breaking of the same pasta.

In view of the state of the art herein described, scope of the present invention is to present a metering machine provided with a device for the fine metering of the pasta that does not show the aforesaid disadvantage.

According to the present invention, such scope is attained by means of a metering machine for pasta comprising a channel for the finishing of the pasta, a shovel for the support of the pasta that gets into said finishing channel, a shovel for the metering of the pasta, said supporting shovel and said metering shovel being transversally insertable into said finishing channel and disinsertable from it in alternative way, characterized in that said metering shovel and said supporting shovel are mechanically connected with each other so that a single driving device provides to their simultaneous and alternative insertion and transversal disinserition.

Owing to the present invention it is possible to realise a device for the fine metering of the pasta provided with a metering machine that has a single control device so as to prevent possible breaks of the pasta and imprecisions in the metering of the same pasta.

The characteristics and the advantages of the present invention will become evident from the following detailed description of an embodiment thereof, that is illustrated for a non limiting example in the enclosed drawings, in which.

Figure 1:
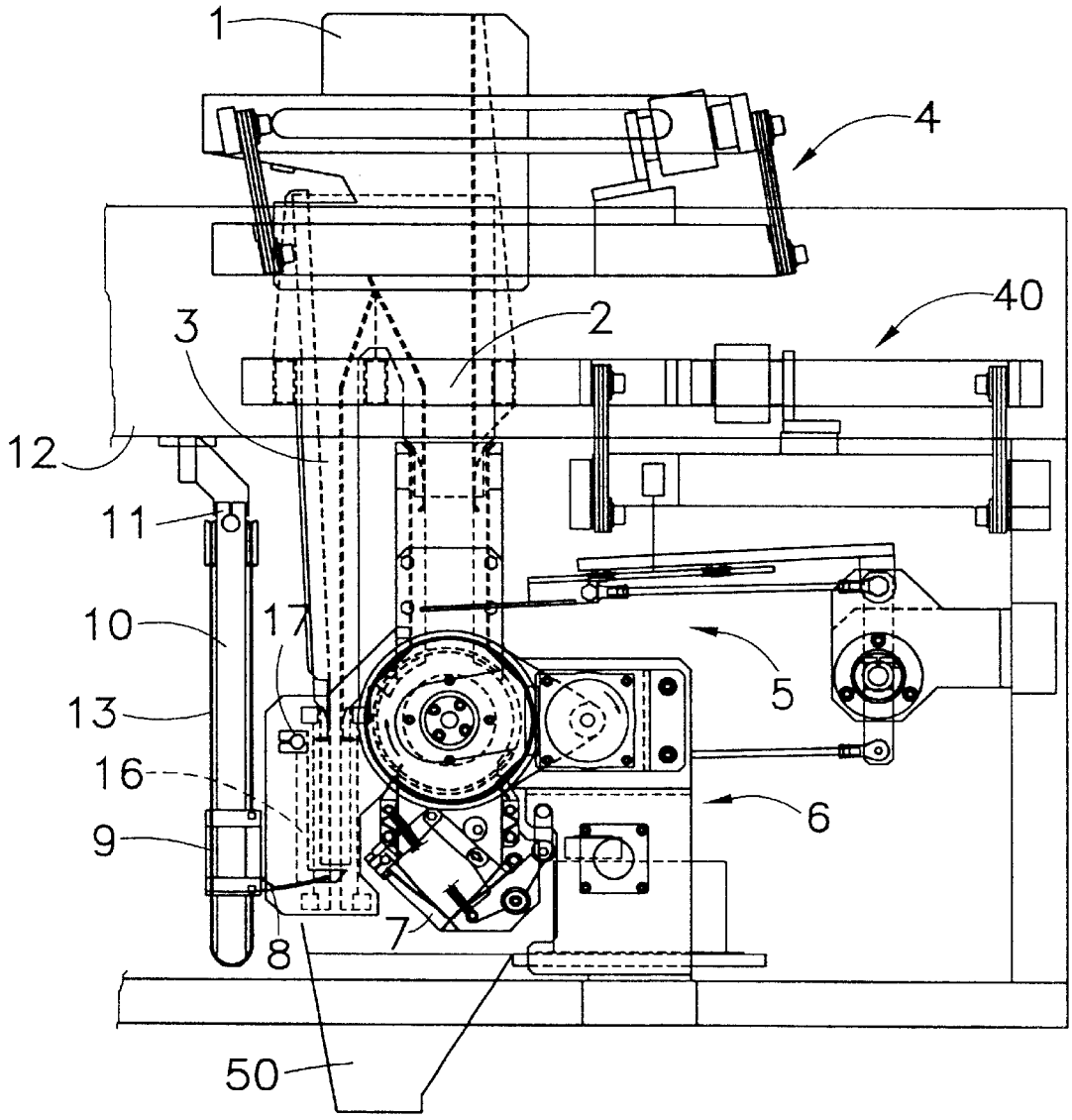
FIG. 1 is a front view of the metering machine according to the present invention.
Figure 3:
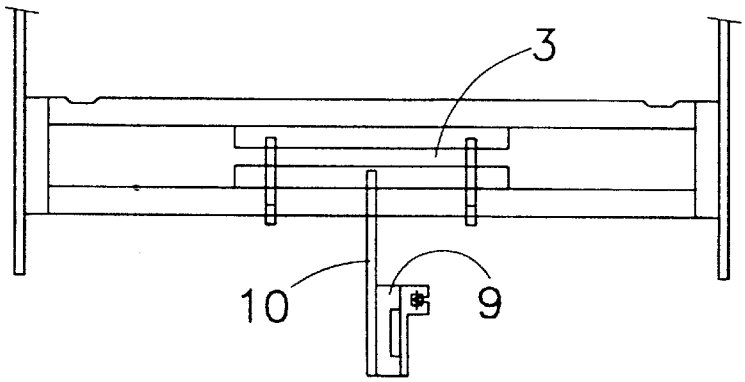
FIG. 3 is a plan view, as regards FIG. 2, of the finishing channel of the metering machine.
Figure 2:
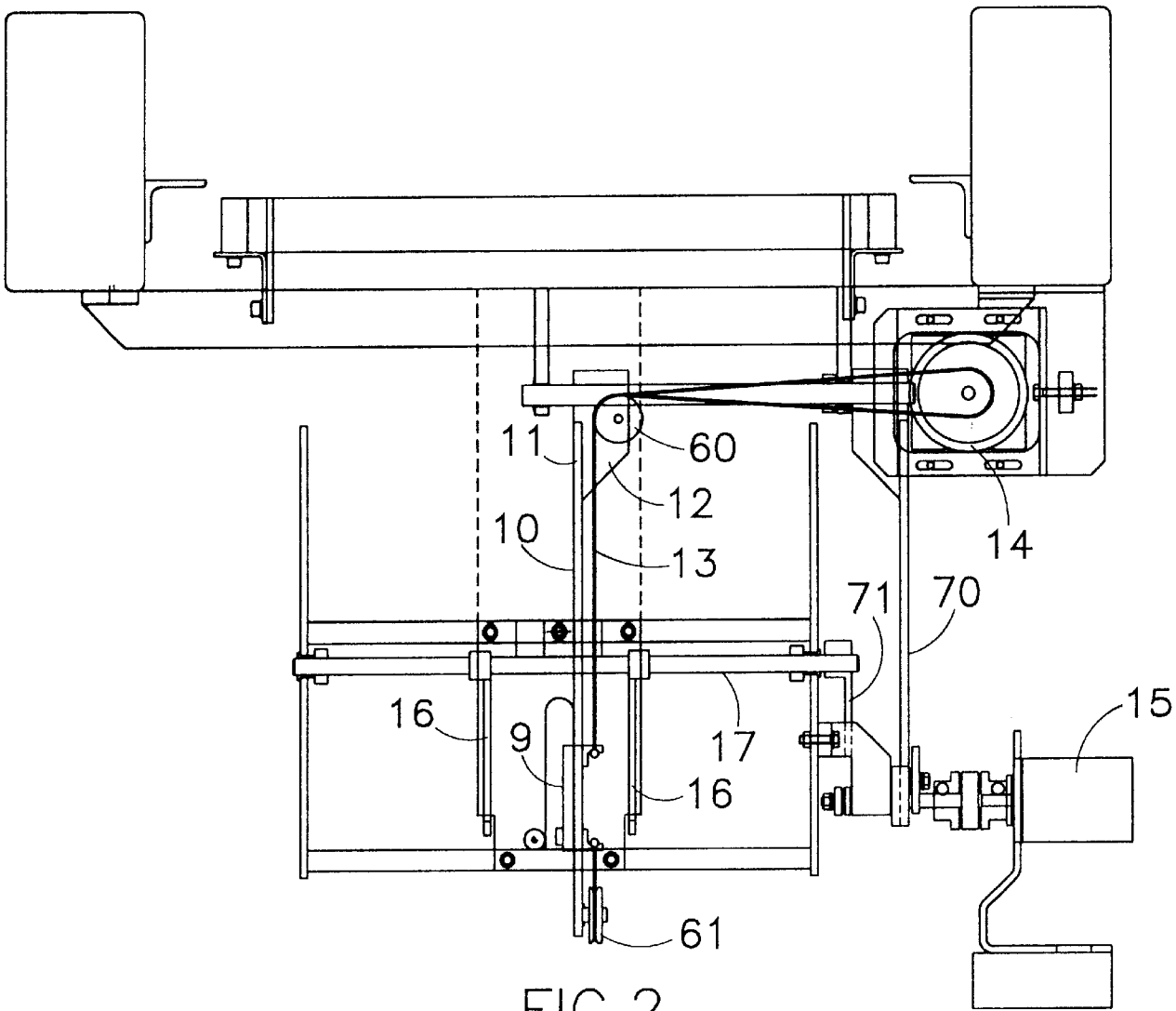
FIG. 2 is a side view from the left of the metering machine in FIG. 1.
Figure 4:
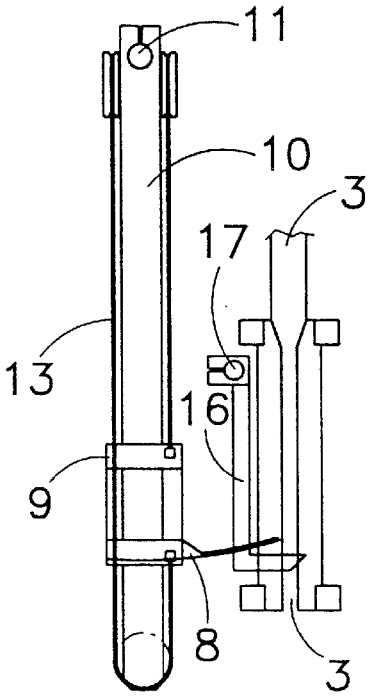
FIGS. 4 and 5 show in front view the detail of the two stages of insertion and disinsertion of the shovels that put into effect the operation of metering of the pasta in the finishing channel of the machine in FIGS. 1 and 2.
Figure 6:
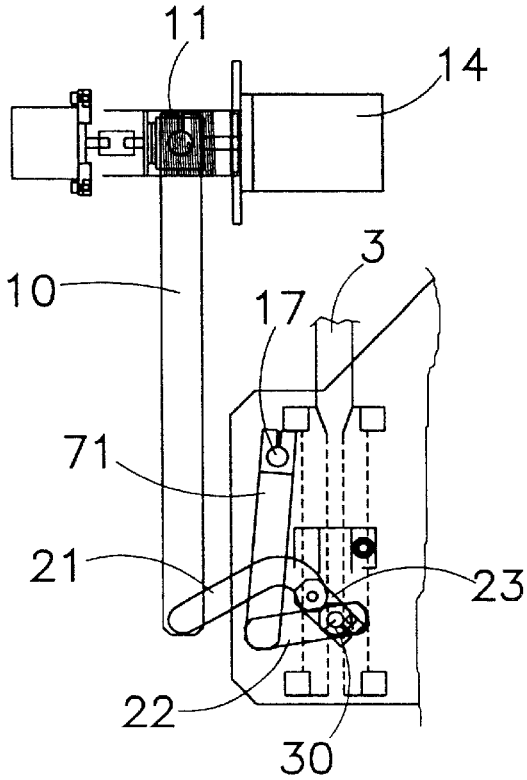
FIGS. 6 and 7 show the same stages as viewed in a plane parallel to the one of FIGS. 4 and 5.
Figure 5:
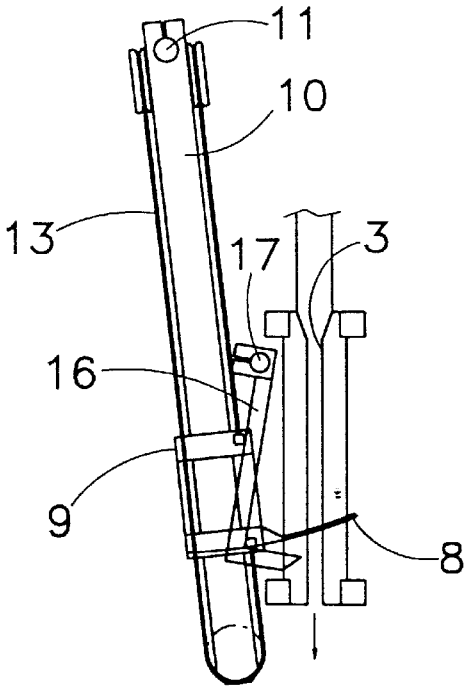
Figure 7:
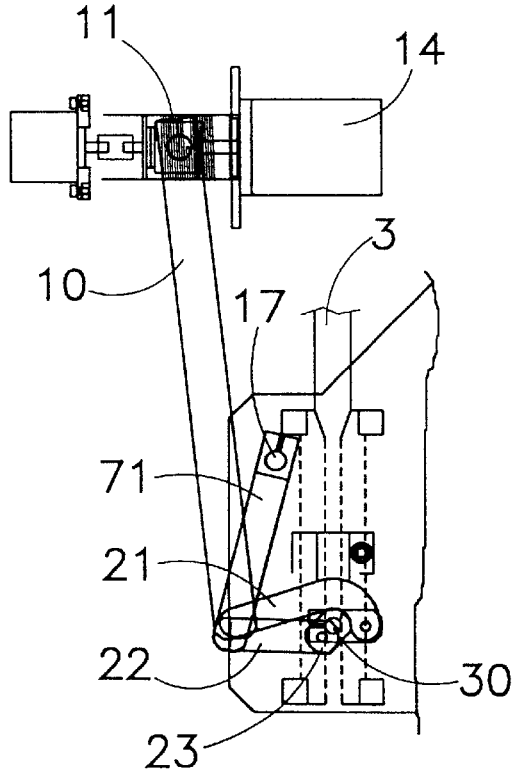

With reference to FIGS. 1–3 a metering machine according to the present invention is shown in which the product, that is long cut pasta, for instance spaghetti, is introduced through a mouth 1 into a roughing channel 2 and a finishing channel 3 by means of oscillations caused by a vibrating device 4 that is located on the top part of the machine. The channel 3 is a channel for the descent of the product for the finishing of the same and it is connected with a second vibrating device 40 in order to facilitate the descent of the pasta into the channel. The roughing channel 2 is connected with a metering device 5 and a weighing device 6 of the pasta that is being collected in a basket 7 that are dealt with in a specific way in a contemporary patent application of the same Applicant.

The pasta that flows into the channel undergoes a metering operation, better visible in FIGS. 4–7, through a metering mechanism comprising a shovel 8 transversally insertable into the finishing channel 3 and connected with a carriage 9 that is vertically movable on a arm 10 revolvingly hinged in 11 to the frame 12 of the metering machine. The carriage 9 is connected through a belt 13 with a stepper motor 14 that by means of two pulleys 60, 61 provides to the vertical movement of the same carriage, while a second stepper motor 15 provides to the movement according to an arc of circumference of the arm 10 through a lever 70. An L-shaped shovel 16 assigned to the support of the pasta in the finishing channel 3 and transversally insertable into it, is revolvingly hinged in 17 to the frame 12 of the metering machine and it is associated in a fixedly mounted way with a lever 71 assigned to its movement. The arm 10 and the lever 71 are connected by means of a leverage 21–23 consisting of a lever 21 hinged to the arm 10, a lever 22 hinged to the lever 71 and connected with the lever 21 through a small V-shaped lever 23. The latter is revolvingly hinged to the lever 21 on one end and at the other end it is revolvingly hinged to the lever 22 and it is hinged in a pin 30 that is provided by the frame 12 of the metering machine. The two ends of the small V-shape lever 23 are at a distance according to an angle greater than a straight angle.

Below the finishing channel 3 one hopper 50 is located for the output of the pasta from the metering machine.

The operation of the machine provides for the aforesaid operation of metering in the finishing channel 3.

Such operation is carried out in two stages shown the FIGS. 4–7. In the FIGS. 4 and 6 the L-shaped shovel 16 is transversally inserted into channel 3 in such a way so as to be in a position of support for the pasta that gets inside channel while the arm 10 is in a position of rest with the motor 15 inactive. In the instant in which the weighing of the pasta is carried out in the roughing channel 2, the device 6 sends an electronic signal that enables the motor 14 for the vertical movement of the carriage 9 so as to adjust the position of the shovel 8 according to the desired amount of pasta. Subsequently the stepper motor 15 is enabled so that the operation of the metering of the pasta in the finishing channel 3, shown in FIGS. 5 and 7 takes place. In such case the metering shovel 8 is inserted transversally in the finishing channel 3 by means of a movement of the arm 10 toward the right under the action of the motor 15; the arm 10 describes an arc of circumference so small that said movement can be considered substantially horizontal. Simultaneously to the movement of the arm 10 there is a movement toward the left of the L-shaped shovel 16 by means of the leverage 21–23. In fact the movement toward the right of the arm 10 determines a sliding and in part rotary movement of the lever 21; this causes a clockwise rotation of the small V-shape lever 23 around the pin 30. This rotation determines a movement toward the left of the lever 22 and a consequent movement toward the left of the shovel 16. In this way the sliding of a small amount of pasta that is contained in the finishing channel 3 into the hopper 50 is obtained.

After such operation a subsequent movement toward the right of the arm 10 and a consequent movement toward the left of the shovel 16 by means of the same leverage 21–23, with counter-clockwise rotation of the small V-shape lever 23 around the pin 30, allows the transversal insertion of the same shovel 16 in the finishing channel 3.

What is claimed is:

1. Metering machine for pasta comprising a finishing channel for the finishing of pasta, a supporting shovel for the support of the pasta that flows in said finishing channel, a metering shovel for the metering of the pasta, said supporting shovel and said metering shovel being transversally insertable in said finishing channel and removable from it in different direction, wherein said metering shovel and said supporting shovel are mechanically connected with each other so that a single driving device alternately provides for their simultaneous transversal insertion and simultaneous transversal removal; and wherein said metering machine comprises a second driving device for the vertical sliding of said metering shovel in a direction parallel to the finishing channel.

2. Metering machine according to claim 1, wherein said metering shovel and said supporting shovel for the support of the pasta are connected through a leverage comprising a first lever connected with said shovel for the metering of pasta and with a second lever hinged to the frame of the metering machine, said second lever being connected with a third lever connected with said shovel for the support of pasta.

3. Metering machine according to claim 2, wherein said second lever is a V-shaped lever.

4. Metering machine according to claim 1, wherein said single driving device is associated with said metering shovel.

5. Metering machine according to claim 1, wherein said metering shovel is fixedly mounted to a carriage that is movable along a vertical guide by means of belts that are connected with said second moving means.

6. Metering machine according to claim 1, wherein said metering machine is a metering machine for long cut pasta.

* * * * *

UNITED STATES PATENT AND TRADEMARK OFFICE

CERTIFICATE OF CORRECTION

PATENT NO. : 6,446,843 B2
DATED : September 10, 2002
INVENTOR(S) : Vezzani

It is certified that error appears in the above-identified patent and that said Letters Patent is hereby corrected as shown below:

Title page,
Item [30], please amend the Foreign Application Priority Data to read as follows:

-- [30] Foreign Application Priority Data
Mar. 2, 2000 (IT) ..... MI2000U000119 --

Signed and Sealed this

Twenty-fourth Day of June, 2003

JAMES E. ROGAN
*Director of the United States Patent and Trademark Office*